US005709919A

United States Patent [19]

Kranzmann et al.

[11] Patent Number: 5,709,919

[45] Date of Patent: Jan. 20, 1998

[54] THERMAL INSULATION

[75] Inventors: Axel Kranzmann, Stuttgart; Ludwig Weiler, Heidelberg, both of Germany

[73] Assignee: ABB Patent GmbH, Mannheim, Germany

[21] Appl. No.: 358,771

[22] Filed: Dec. 19, 1994

[30] Foreign Application Priority Data

Dec. 17, 1993 [DE] Germany ..... 43 43 120.8

[51] Int. Cl.[6] ..... B44C 1/26

[52] U.S. Cl. ..... 428/67; 428/120; 110/336; 60/752; 60/753

[58] Field of Search ..... 428/120, 67; 110/336; 60/752, 753

[56] References Cited

U.S. PATENT DOCUMENTS

| | | | |
|---|---|---|---|
| 4,709,643 | 12/1987 | Moreno et al. | 110/336 |
| 5,083,424 | 1/1992 | Becker | 60/39.31 |
| 5,331,816 | 7/1994 | Able et al. | 60/753 |

*Primary Examiner*—Christopher Raimund

[57] ABSTRACT

Combustion plants and gas turbines have inner regions through which hot gases flow. A thermal insulation for the inner regions includes a fiber composite having a surface. A protection against destruction is disposed at the surface.

10 Claims, 4 Drawing Sheets

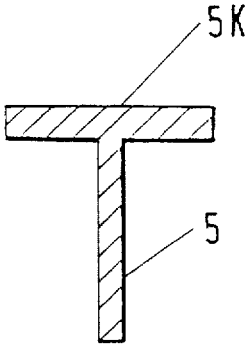
Fig.4
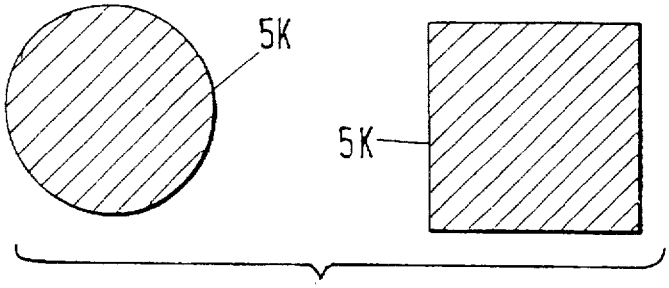
Fig.5
Fig.6
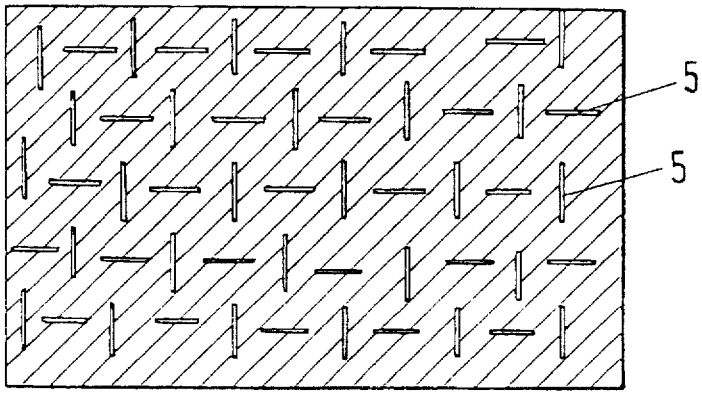
Fig.7
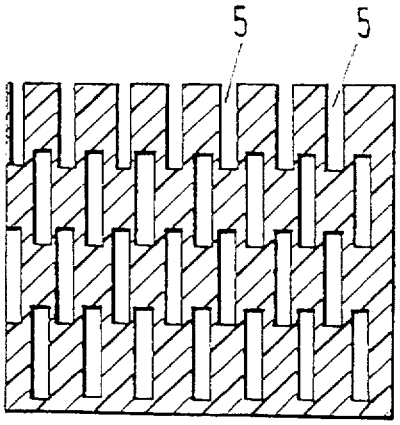
Fig.8
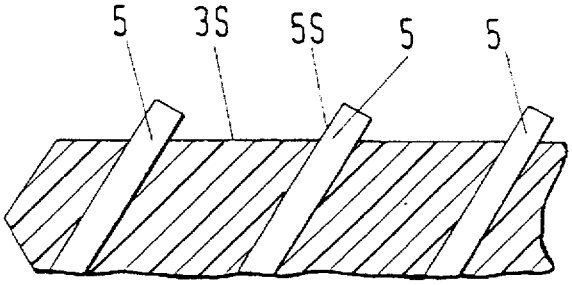

THERMAL INSULATION

BACKGROUND OF THE INVENTION

FIELD OF THE INVENTION

The invention relates to a thermal insulation being formed of a fiber composite for inner regions of combustion plants and gas turbines, through which inner regions hot gases flow.

Thermal insulations being formed of fiber composites which are used for the insulation of streams of hot gas undergo the destructive attacks of gas components and slags which are possibly carried along in the gas, as well as alternating thermal stresses. Those adverse effects become noticeable particularly when the insulation is used in combustion plants and gas turbines. The destruction of the fiber composite takes place more quickly as the particle load in the gas stream and the temperature in the plants become higher. Where stationary gas turbines are concerned, the surface must withstand thermal stresses of up to 1500° C. and alternating thermal stresses.

The measures which were carried out heretofore for hardening the surface of the fiber composite, such as, for example, homogeneous infiltration or protective tiles, can only slightly reduce the destruction of the fiber composite. On the other hand, the measures are sometimes highly cost-intensive and associated with risks for the user. The risks include damage to the tile fixing caused by thermal shock, which can lead to its failure.

SUMMARY OF THE INVENTION

It is accordingly an object of the invention to provide a thermal insulation, which overcomes the hereinaforementioned disadvantages of the heretofore-known products of this general type and which is formed of a fiber composite for combustion plants and gas turbines that is resistant to the destructive effects of hot gases and of alternating thermal stresses.

With the foregoing and other objects in view there is provided, in accordance with the invention, in combustion plants and gas turbines having inner regions through which hot gases flow, a thermal insulation for the inner regions, comprising a fiber composite having a surface, and means disposed at the surface for protecting against destruction.

In accordance with another feature of the invention, the protecting means are in the form of bar-shaped or plate-shaped reinforcing elements.

In accordance with a further feature of the invention, the bar-shaped or plate-shaped reinforcing elements are partially or completely integrated into the fiber composite.

The plate-shaped and bar-shaped reinforcing elements being used for protecting the fiber composite can be matched very easily to the requirements of insulation, adhesive strength, gas-flow direction and particle load in the hot gas. The materials used for producing the fiber composites and the reinforcing elements can be coordinated with one another without additional outlay. The material of the reinforcing elements can likewise be matched to the destructive thermal conditions of the combustion plants or gas turbines. A visual check of the thermal insulation within the combustion plants and gas turbines is easily possible. Cracks in the insulation occur only very slowly, but with a pronounced crack opening, so that they can be recognized immediately. Since the reinforcing elements are disposed in a predetermined way in the surface region, places where reinforcing elements are broken out are easily recognizable.

In accordance with an added feature of the invention, the reinforcing elements are integrated into the fiber composite during the production of the insulation or, if necessary, at a later stage. As a result of the special configuration of bar-shaped and plate-shaped reinforcing elements, the gas stream can be kept away from the surface of the thermal insulation. This is possible in all instances, irrespective of whether the gas stream runs parallel to the surface of the thermal insulation or whether the hot gas flows directly against the thermal insulation. The thermal insulation can be exposed to the effects of hot gases up to temperatures of 6000° C., even when these are laden with sulphur, oil, ashes, oxygen, alkalis, alkaline earths and vanadium.

In accordance with an additional feature of the invention, the reinforcing elements have a region with a given length protruding beyond the surface of the fiber composite and a given perpendicularly measured spacing between two adjacent reinforcing elements, the given length and given spacing determining a maximum permissible onflow angle of the hot gas.

In accordance with yet another feature of the invention, the reinforcing elements have ends disposed in the fiber composite, and additional anchorings for the ends.

In accordance with yet a further feature of the invention, the reinforcing elements are disposed in rows, and the reinforcing elements of each row are offset relative to the reinforcing elements of two directly adjacent rows.

In accordance with yet an added feature of the invention, the bar-shaped or plate-shaped reinforcing elements are formed of a ceramic material and preferably of the same material as the fiber composite.

In accordance with yet an additional feature of the invention, the given spacing is inversely proportional to the size of the onflow angle of the hot gas.

In accordance with again another feature of the invention, the bar-shaped reinforcing elements have a given diameter, define a smallest spacing between two of the bar-shaped reinforcing elements of a row being equal to the given diameter, and define a spacing between two adjacent rows of the bar-shaped reinforcing elements also corresponding to the given diameter.

In accordance with again a further feature of the invention, the bar-shaped reinforcing elements each have an end facing the hot gas with a round or a rectangular head.

In accordance with a concomitant feature of the invention, the plate-shaped reinforcing elements each have a surface forming an angle of between 10° and 70° with the surface of the fiber composite.

Other features which are considered as characteristic for the invention are set forth in the appended claims.

Although the invention is illustrated and described herein as embodied in a thermal insulation, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 4 is a longitudinal-sectional view showing a bar-shaped reinforcing element with a head;

FIG. 5 includes cross-sectional views of a round head and a rectangular head of a bar-shaped reinforcing element; and FIGS. 6, 7 and 8 are sectional views showing configurations of plate-shaped reinforcing elements.

DESCRIPTION OF THE PREFERRED EMBODIMENTS

Figure 1:
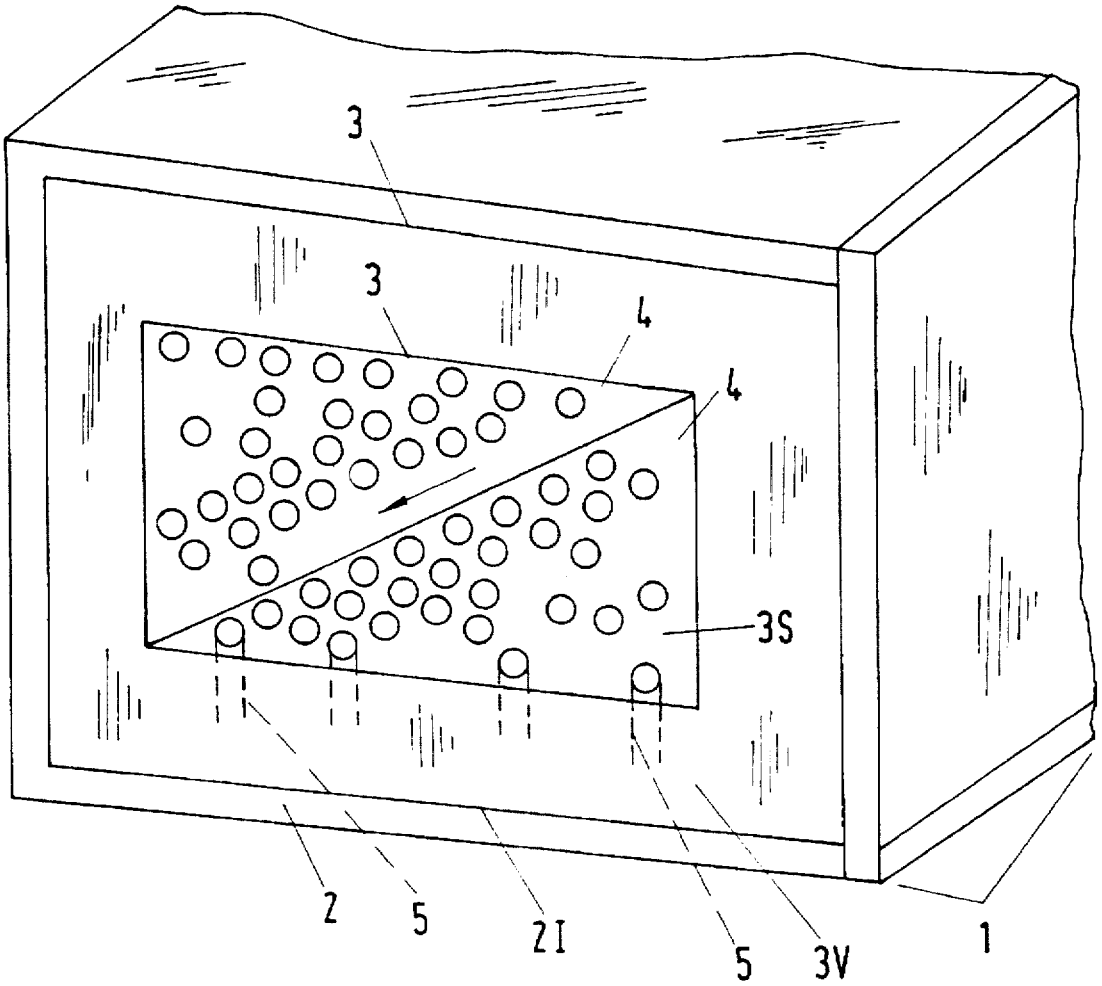
FIG. 1 is a fragmentary, diagrammatic, perspective view of a combustion plant.

Referring now to the figures of the drawing in detail and first, particularly, to FIG. 1 thereof, there is seen a portion of a combustion plant 1. Attached to inner surfaces 2I of the combustion plant 1 is an insulation 3 which is produced from a fiber composite 3V. An integral part of this fiber composite 3V is constituted by ceramic fibers which are cast together with a binder to form the insulation 3. The insulation 3 screens off a channel 4, in which a non-illustrated hot gas is guided in the direction of an arrow. Means are disposed on surfaces 3S of the insulation 3 to protect the fiber composite 3V from destruction. In the exemplary embodiment which is illustrated in this case, these means are formed by bar-shaped reinforcing elements 5. The bar-shaped reinforcing elements 5 are disposed in such a way that their longitudinal axes extend perpendicularly to the surface 3S. The bar-shaped reinforcing elements 5 have a diameter of 2 to 5 mm and their length is 10 to 25 mm. If the gas only flows parallel to the surfaces 3S, then the bar-shaped reinforcing elements 5 are disposed in the fiber composite 3V in such a way that ends of the bar-shaped reinforcing elements 5 facing the channel terminate flush with the surface 3S of the insulation 3 or are embedded a few mm in the surface 3S. As can be seen from FIG. 1, the bar-shaped reinforcing elements 5 are disposed irregularly when the gas flows parallel to the surfaces 3S of the insulation 3. As a result of the configuration of the reinforcing elements 5, after an initial pronounced stripping of the fiber composite, an optimum surface structure will form, since destruction is prevented completely by the reinforcing elements 5 that are gradually protruding from the surface.

Figure 2:
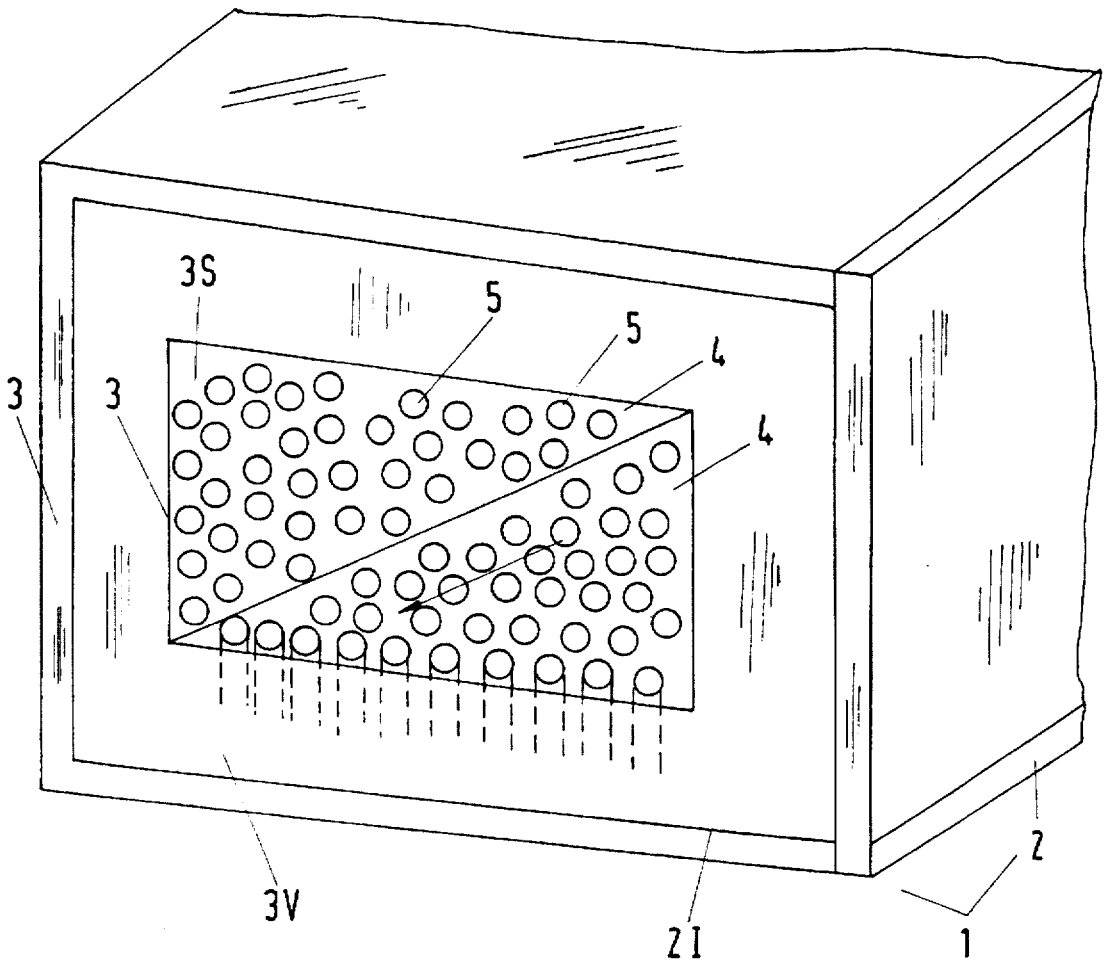
FIG. 2 is diagrammatic, perspective view of an alternative version of the configuration illustrated in FIG. 1.

If the hot gas within the channel 4 does not flow parallel to the surfaces 3S, but against the surface 3S at a specified onflow angle, a special configuration of the bar-shaped reinforcing elements 5 is required. For this purpose, as is shown in FIG. 2, the bar-shaped reinforcing elements are disposed in rows in the region of each surface 3S. The bar-shaped reinforcing elements 5 of adjacent rows are additionally offset relative to one another, specifically in such a way that no free passages for the gas remain between the bar-shaped reinforcing elements 5, as is seen in the direction of flow of the hot gas. This ensures that the gas is deflected from the surface 3S by the reinforcing elements 5. The spacing between two reinforcing elements 5 of one row should correspond at least to the diameter of one reinforcing element 5. The same applies to the vertical spacing between two adjacent rows of reinforcing elements 5. The reinforcing elements 5 illustrated in FIGS. 1 and 2 are placed in the region of the surfaces 3S as early as during the casting of the fiber composite 3V and are anchored directly by means of the binding phases occurring during the consolidation of the fiber composite 3V. According to the invention, the reinforcing elements 5 can also be introduced into the insulation 3 at a later stage. For this purpose, the surfaces 3S of the insulation 3 must be provided with non-illustrated bores, into which the bar-shaped reinforcing elements 5 can be lowered. The fixing of the reinforcing elements 5 then takes place by means of a non-illustrated ceramic adhesive.

The length of the bar-shaped reinforcing elements 5 determines the lifespan and insulating effect of the fiber composite 3V. Long bar-shaped reinforcing elements 5 lower the insulating effect locally. An optimum insulating effect is achieved by producing the bar-shaped reinforcing elements 5 from zirconium dioxide, since this material conducts heat only at 3 to 5.5 $W \cdot m^{-1} \cdot K^{-1}$. However, they can also be produced from $Al_2O_3$, mullite, magnesium oxide or a spinel. Due to their small cross-section, bar-shaped reinforcing elements 5, such as are described herein, have the highest resistance to alternating thermal stresses, given an identical material. Moreover, they can be constructed with a solid or a hollow profile. When reinforcing elements with hollow profiles are used, the weight of the thermal insulation 3 is reduced appreciably.

Figure 3:
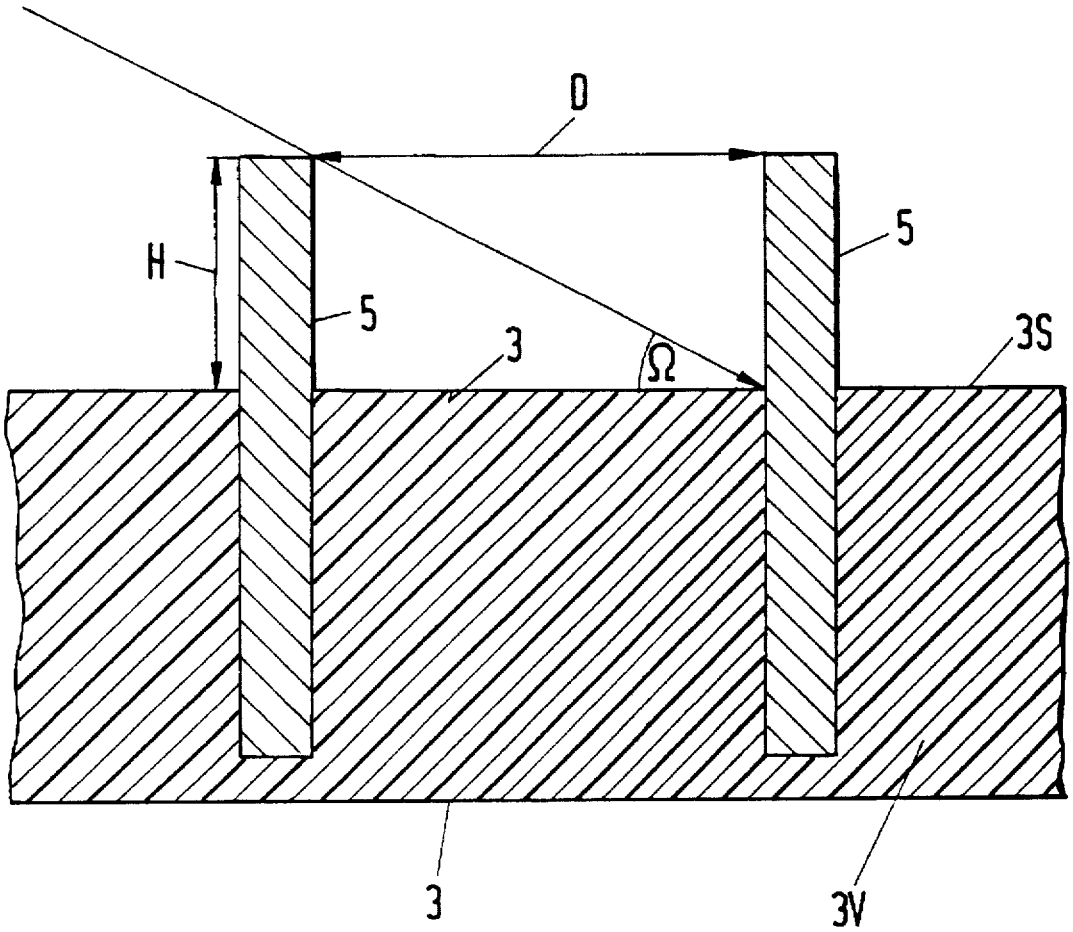
FIG. 3 is a fragmentary, longitudinal-sectional view showing possible onflow angles of hot gas.

As is shown in FIG. 3, a maximum onflow angle $\Omega$ at which the hot gas may flow against the surfaces 3S can be determined from a length H with which the reinforcing elements 5 protrude from the surface 3S of the insulation 3, and a perpendicularly measured or normal spacing D between two bar-shaped reinforcing elements 5, as follows: $\Omega = \arctan(H/D)$.

$\Omega$=11.3°, 21.8°, 30.9°, 38.7°, 45° for

H=1 mm, 2 mm, 3 mm, 4 mm, 5 mm and

D=5 mm, 5 mm, 5 mm, 5 mm, 5 mm.

At onflow angles $\Omega$ which are small, bar-shaped reinforcing elements 5 afford optimum protection in this configuration.

If the hot gas has an onflow angle $\Omega$ which is larger than 60° and if this hot gas is additionally laden with particles, then reinforcing elements 5 such as are illustrated in FIGS. 4 and 5, are preferably used. Those reinforcing elements 5 are likewise bar-shaped reinforcing elements. However, such reinforcing elements 5 are provided at an end thereof protruding from the surface 3S of the insulation with a head 5K which is constructed as a round or rectangular plate. The diameter of the head 5K corresponds approximately to ten times that of the bar-shaped part of the reinforcing element 5. Bar-shaped reinforcing elements 5 of such a construction can be used at any onflow angle, without further measures having to be taken with regard to the configuration of the reinforcing elements. However, these reinforcing elements 5 can break out from the fiber composite 3V more easily than the reinforcing elements 5 without a head. In order to prevent this, additional non-illustrated anchoring elements are disposed at first ends of these reinforcing elements, which are the ends that are disposed well inside the insulation. Ceramic adhesives or metallo-organic precursors of the binder, mixed with ceramic powders of the same kind, are appropriate for this purpose.

FIG. 6 shows a thermal insulation 3 which is provided in its surface region 3S with plate-shaped reinforcing elements 5. These plate-shaped reinforcing elements 5 are likewise disposed in rows, and specifically in such a way that the planes of two adjacent reinforcing elements 5 extend perpendicularly to one another. The directly adjacent rows of reinforcing elements 5 are disposed offset, so that the planes of two reinforcing elements 5 located directly opposite one another are likewise disposed perpendicularly to one another.

FIG. 7 shows a top view of a further possibility of a way in which plate-shaped reinforcing elements 5 can be disposed. Preferably, plate-shaped reinforcing elements 5 according to FIG. 8 are disposed in the fiber composite 3 in such a way that their surfaces 5S form an angle of between 10° and 70°, and preferably between 45° and 60°, with the surface 3S of the fiber composite 3V.

We claim:

1. In combustion plants and gas turbines having inner regions through which hot gases flow, a thermal insulation for the inner regions, the thermal insulation comprising:

a fiber composite having a surface, reinforcing elements disposed at said surface for protecting against destruction, said reinforcing elements being disposed in rows, and said reinforcing elements of each row being offset relative to said reinforcing elements of two directly adjacent rows, and said reinforcing elements being bars and having a given diameter, said given diameter being equal to the smallest spacing between any two adjacent bars of a row, and said given diameter corresponding to a spacing between two adjacent rows of said bars.

2. In combustion plants and gas turbines having inner regions through which hot gases flow, a thermal insulation for the inner regions, the thermal insulation comprising:

a fiber composite having a surface, bars being reinforcing elements disposed at said surface for protecting against destruction, and said bars each have an end facing the hot gas with a round head.

3. In combustion plants and gas turbines having inner regions through which hot gases flow, a thermal insulation for the inner regions, the thermal insulation comprising:

a fiber composite having a surface, bars being reinforcing elements disposed at said surface for protecting against destruction, and said bars each have an end facing the hot gas with a rectangular head.

4. In combustion plants and gas turbines having inner regions through which hot gases flow, a thermal insulation for the inner regions, the thermal insulation comprising:

a fiber composite having a surface, plates being reinforcing elements disposed at said surface for protecting against destruction, and said plates each having a surface forming an angle of between 10° and 70° with said surface of said fiber composite.

5. In combustion plants and gas turbines having inner regions through which hot gases flow, a thermal insulation for the inner regions, the thermal insulation comprising:

a fiber composite having a surface, bars being reinforcing elements disposed at said surface for protecting against destruction, said bars being at least partially integrated into said fiber composite, said bars each having an end disposed in said fiber composite, and additional anchorings for said ends, said given spacing being inversely proportional to the size of the onflow angle of the hot gas, said bars being disposed in rows, and said reinforcing elements of each row are offset relative to said reinforcing elements of two directly adjacent rows, and said bars having a given diameter, said given diameter being equal to a smallest spacing between two of said bars of a row, and said given diameter corresponding to a spacing between two adjacent rows of said bars.

6. The thermal insulation according to claim 5, wherein said bars are formed of a ceramic material.

7. The thermal insulation according to claim 5, wherein said bars are formed of the same material as said fiber composite.

8. The thermal insulation according to claim 5, wherein said bars each have an end facing the hot gas with a round head.

9. The thermal insulation according to claim 5, wherein said bars each have an end facing the hot gas with a rectangular head.

10. In combustion plants and gas turbines having inner regions through which hot gases flow, a thermal insulation for the inner regions, the thermal insulation comprising:

a fiber composite having a surface, plates being reinforcing elements disposed at said surface for protecting against destruction, said plates being at least partially integrated into said fiber composite, and said plates each having a surface forming an angle of between 10° and 70° with said surface of said fiber composite.

* * * * *